US007287300B2

(12) United States Patent
Rupp et al.

(10) Patent No.: US 7,287,300 B2
(45) Date of Patent: Oct. 30, 2007

(54) PORTABLE VACUUM SYSTEM

(75) Inventors: Mark Rupp, Whitehouse, OH (US); Mike Siler, Toledo, OH (US)

(73) Assignee: NSS Enterprises, Inc., Toledo, OH (US)

( * ) Notice: Subject to any disclaimer, the term of this patent is extended or adjusted under 35 U.S.C. 154(b) by 549 days.

(21) Appl. No.: 10/888,051

(22) Filed: Jul. 9, 2004

(65) Prior Publication Data

US 2006/0005346 A1 Jan. 12, 2006

(51) Int. Cl.
*A47L 5/36* (2006.01)

(52) U.S. Cl. ..... 15/327.6; 15/327.5; 15/347; 15/352

(58) Field of Classification Search ..... 15/327.5, 15/327.6, 347, 352, 353, 314; *A47L 5/36*
See application file for complete search history.

(56) References Cited

U.S. PATENT DOCUMENTS

| | | | | |
|---|---|---|---|---|
| 1,047,164 | A | 12/1912 | Butenschoen | |
| 1,099,560 | A | 6/1914 | Matchette | |
| 1,219,756 | A * | 3/1917 | Meredith-Jones | 15/327.6 |
| 2,392,205 | A | 1/1946 | Wales | |
| 2,635,276 | A * | 4/1953 | Norris | 15/353 |
| 2,731,103 | A * | 1/1956 | Ortega | 15/353 |
| 3,165,774 | A | 1/1965 | Barba | |
| 3,308,608 | A | 3/1967 | Brimberg | |
| 3,331,090 | A | 7/1967 | Reiber et al. | |
| 4,715,872 | A * | 12/1987 | Snyder | 15/347 |
| 4,748,712 | A | 6/1988 | DiGiovanni | |
| 4,944,065 | A | 7/1990 | Svanberg et al. | |
| 5,014,388 | A | 5/1991 | Schiazza et al. | |
| 5,032,155 | A * | 7/1991 | Wiese et al. | 15/353 |
| 5,062,870 | A | 11/1991 | Dyson | |
| D326,747 | S | 6/1992 | Stickle | |
| 5,145,499 | A | 9/1992 | Dyson | |
| 5,267,371 | A | 12/1993 | Soler et al. | |
| D371,676 | S | 7/1996 | Geddes, Sr. | |
| 5,588,177 | A | 12/1996 | Eriksen | |
| 5,935,279 | A | 8/1999 | Kilström | |
| 5,943,732 | A | 8/1999 | Bosyj et al. | |
| 6,003,196 | A | 12/1999 | Wright et al. | |
| 6,026,540 | A | 2/2000 | Wright et al. | |
| 6,049,941 | A | 4/2000 | Vollenweider, II | |
| 6,066,211 | A | 5/2000 | Sandell | |
| 6,070,291 | A | 6/2000 | Bair et al. | |
| 6,073,301 | A | 6/2000 | Berfield | |
| 6,146,434 | A | 11/2000 | Scalfani et al. | |
| 6,151,749 | A | 11/2000 | Berfield | |
| RE37,081 | E | 3/2001 | Eriksen | |

(Continued)

OTHER PUBLICATIONS www.liveupdater.com; Advance Clean Product Inquiry Form; Polivac Backpack; website pate; all.

(Continued)

*Primary Examiner*—Theresa T. Snider
(74) *Attorney, Agent, or Firm*—Marshall & Melhorn LLC

(57) ABSTRACT

A backpack mounted portable vacuum system is provided having a motor portion and a filter portion. The motor portion is cylindrically shaped and has a first vertical axis. The filter portion is also cylindrically shaped and has a second vertical axis that is horizontally offset from the first vertical axis. The horizontal offset provides for a larger debris container and debris fluid path.

29 Claims, 7 Drawing Sheets

U.S. PATENT DOCUMENTS

| | | | |
|---|---|---|---|
| 6,195,835 | B1 | 3/2001 | Song et al. |
| D446,365 | S | 8/2001 | Bisson |
| 6,295,692 | B1 | 10/2001 | Shideler |
| 6,305,048 | B1 | 10/2001 | Salisian |
| 6,393,656 | B1 | 5/2002 | Paterson et al. |
| 6,398,834 | B2 | 6/2002 | Oh |
| 6,406,505 | B1 | 6/2002 | Oh et al. |
| 6,432,154 | B2 | 8/2002 | Oh et al. |
| 6,440,197 | B1 | 8/2002 | Conrad et al. |
| 6,482,246 | B1 | 11/2002 | Dyson et al. |
| 6,553,610 | B1 | 4/2003 | Shideler |
| 6,568,026 | B2 | 5/2003 | Roy et al. |
| 6,596,044 | B1 | 7/2003 | Bilek et al. |
| 6,623,539 | B2 | 9/2003 | Lee et al. |
| D482,166 | S | 11/2003 | Paterson |
| 6,647,586 | B2 | 11/2003 | Rogers et al. |
| 6,660,053 | B2 | 12/2003 | Oh et al. |
| 6,662,403 | B2 | 12/2003 | Oh |
| 6,702,868 | B2 | 3/2004 | Oh et al. |
| 6,712,868 | B2 | 3/2004 | Murphy et al. |
| 2001/0049854 | A1 | 12/2001 | Dalbey |
| 2003/0070250 | A1 | 4/2003 | Roy et al. |

OTHER PUBLICATIONS www.liveupdater.com; Advance Clean Product Inquiry Form; Nilfisk BV1100; website page; all.

www.liveupdater.com; Advance Clean Product Inquiry Form; Nilfisk Backuum; website page; all.

www.vactrack.com; Ergonomics & Backpack Vacs; webstie page; all.

Tennant Company; Tennant Model 3090; website page; all.

www.parish-supply.com; Nobles-Backpack Vacuum Cleaner; website page; all; Parish Maintenance Supply, Syracuse, New Yrok, USA.

* cited by examiner

PORTABLE VACUUM SYSTEM

FIELD OF THE INVENTION

The present invention relates to a portable vacuum system and more specifically to a backpack mounted portable vacuum system.

BACKGROUND OF THE INVENTION

Portable vacuum systems, namely, backpack mounted vacuum systems, are well known in the art. For example, U.S. Pat. No. 1,047,164 provides for a backpack mounted cotton picking machine having a vacuum mounted to the backpack and a battery located in a battery compartment on a waist belt. A wire connects the battery with the vacuum to supply power thereto.

U.S. Pat. No. 4,748,712 teaches a backpack mounted vacuum cleaner system with a rechargeable battery that can be removed and replaced. Alternatively, the system can have both a rechargeable battery and an electrical plug for connecting with an external power source. A blower motor is connected to the battery or plug to spin the fan in the blower and pull debris-laden air through a cloth separation means. The cloth separation means retains the collected debris for subsequent removal.

U.S. Pat. No. 5,267,371 teaches a backpack mounted vacuum cleaner system having a lower casing designed to be releasably mounted to an upper casing. The lower casing is a debris collector. An air entry port supplies dirt laden air tangentially to the interior surface of the lower casing. The air entry port may be located on either the right or left side of the system. A centrifugal force is applied to the dirt-laden air causing it to rotate within chamber. The larger and heavier dirt is deposited in the lower portion of the lower casing. The air moves upwardly where it passes through the motor and then through an exit port designed to direct air away from the operator. A HEPA type filter may be located in the exit port.

U.S. Pat. No. 6,066,211 teaches a handheld, battery-powered electric vacuum cleaner system having a battery pouch attached to a belt. The battery pouch is used for holding a rechargeable and replaceable battery. A power cord connects the battery to the motor portion of the vacuum cleaner.

U.S. Pat. No. 6,568,026 provides for a backpack mounted vacuum system. A canister is removably attached to the bottom portion of the backpack. The canister collects debris from the air stream and contains a filter. A vacuum motor is located in the upper portion of the backpack, thus drawing air through the hose, into the canister, through the filter and then out the top of the vacuum through outlets.

U.S. Pat. No. 6,553,610 provides for a modular backpack vacuum system. The device comprises a filter unit and a motor unit that are designed to be releasably attached to each other. The patent states that multiple filter units could be used for different purposes. For example, one filter unit could have a HEPA filter or another could have a wet/dry filter. Depending on the application, the filter unit could be selected and attached to the motor unit. The filter unit can be attached to the motor unit with pins, compression fittings, band fittings and/or screw type threads. Use of a standard electrical connection, or rechargeable batteries, as a power source is generally disclosed.

U.S. Pat. No. 6,647,586 discloses a portable vacuum system that can be configured to wear as a backpack. A power source, such as a set of rechargeable batteries, may be used to power the vacuum motor. The motor, power source and debris bag are contained within either a semi-rigid or rigid enclosure. A collapsible debris wand is connected to the backpack.

The prior art described above all suffers from the same disadvantage. Namely, the prior art designs fail to provide a sufficient debris laden fluid path into the debris-collecting portion of the system. The debris laden fluid paths provided the systems described above are likely to clog thus reducing the efficiency of the vacuum system.

The prior art systems also are not designed to reduce strain and fatigue to the operator. More specifically, the handle portions of the prior art vacuum systems do not facilitate control over, or operation of, the floor brush and the vacuum system.

In light of these disadvantages, a backpack mounted vacuum system which is designed to reduce the likelihood of clogs and increase operator efficiency is needed.

SUMMARY OF THE INVENTION

The present invention is directed toward a portable vacuum system having a filter portion and a motor portion. The filter portion houses at least one filter and has a first vertical axis. The motor portion houses a motor and has a second vertical axis. The motor portion is preferably connected to the filter portion such that the first vertical axis is horizontally offset from the second vertical axis.

At least two debris inlets are attached to the filter portion. Preferably, the debris inlets communicate debris in the debris fluid path tangentially into an interior portion of the filter portion.

A flexible vacuum hose is attached to either one of the two debris inlets. The vacuum hose is connected to a debris wand that is held by the operator to position the floor head over areas to be cleaned. More specifically, the debris wand has a handle with a trigger selectively biased to interrupt an electrical circuit between the motor and a power source.

BRIEF DESCRIPTION OF THE DRAWINGS

The above, as well as other advantages of the present invention, will become readily apparent to those skilled in the art from the following detailed description when considered in the light of the accompanying drawings in which.

DETAILED DESCRIPTION OF THE PREFERRED EMBODIMENTS

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions, directions or other physical characteristics relating to the embodiments disclosed are not to be considered as limiting, unless the claims expressly state otherwise.

Figure 1:
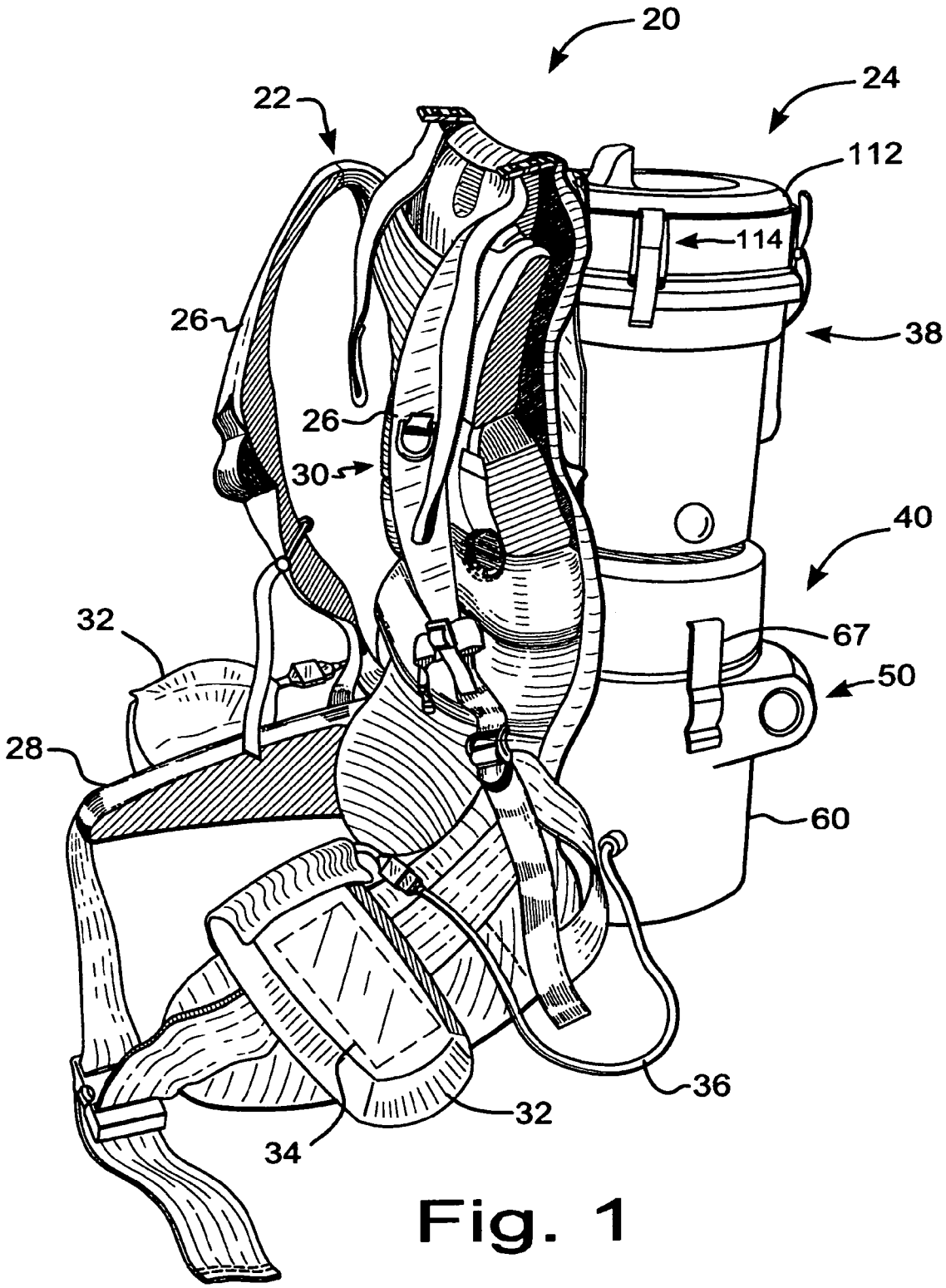
FIG. 1 is a perspective view of an embodiment of the present invention.

FIG. 1 depicts a preferred embodiment of a portable vacuum system 20 according to the present invention. The portable vacuum system 20 comprises a harness system 22 and a vacuum system 24. Preferably, the harness system 22 is designed to support the vacuum system 24 on an operator's back. The harness system 22 has at least two shoulder straps 26 and at least one waist strap 28 for securing and supporting the vacuum system 24 on the operator's back. Preferably, the back 30 of the harness system 22 is padded and designed to conform to the operator's back to maximize the operator's comfort when the portable vacuum system 20 is being worn. Those skilled in the art will appreciate that the vacuum system 24 can be used with other harness systems, or even without a harness system 22, without departing from the scope or spirit of the present invention.

In the preferred embodiment, at least two battery pack compartments 32 are releasably secured to the waist strap 28. One or more rechargeable or non-rechargeable batteries 34 are located within the compartments 32. At least one wire 36 electrically connects the batteries 34 within the compartments 32 to the vacuum system 24 to provide electrical power to the vacuum system 24 as described in more detail below.

By way of example only, the batteries 34 may be nickel metal hydride batteries electrically connected in series. Preferably, a plurality of nickel metal hydride batteries are connected in series to provide sufficient voltage for a sufficient amount of time to run the vacuum system 24. Those skilled in the art will appreciate that other types of batteries may also be used.

Figure 2:
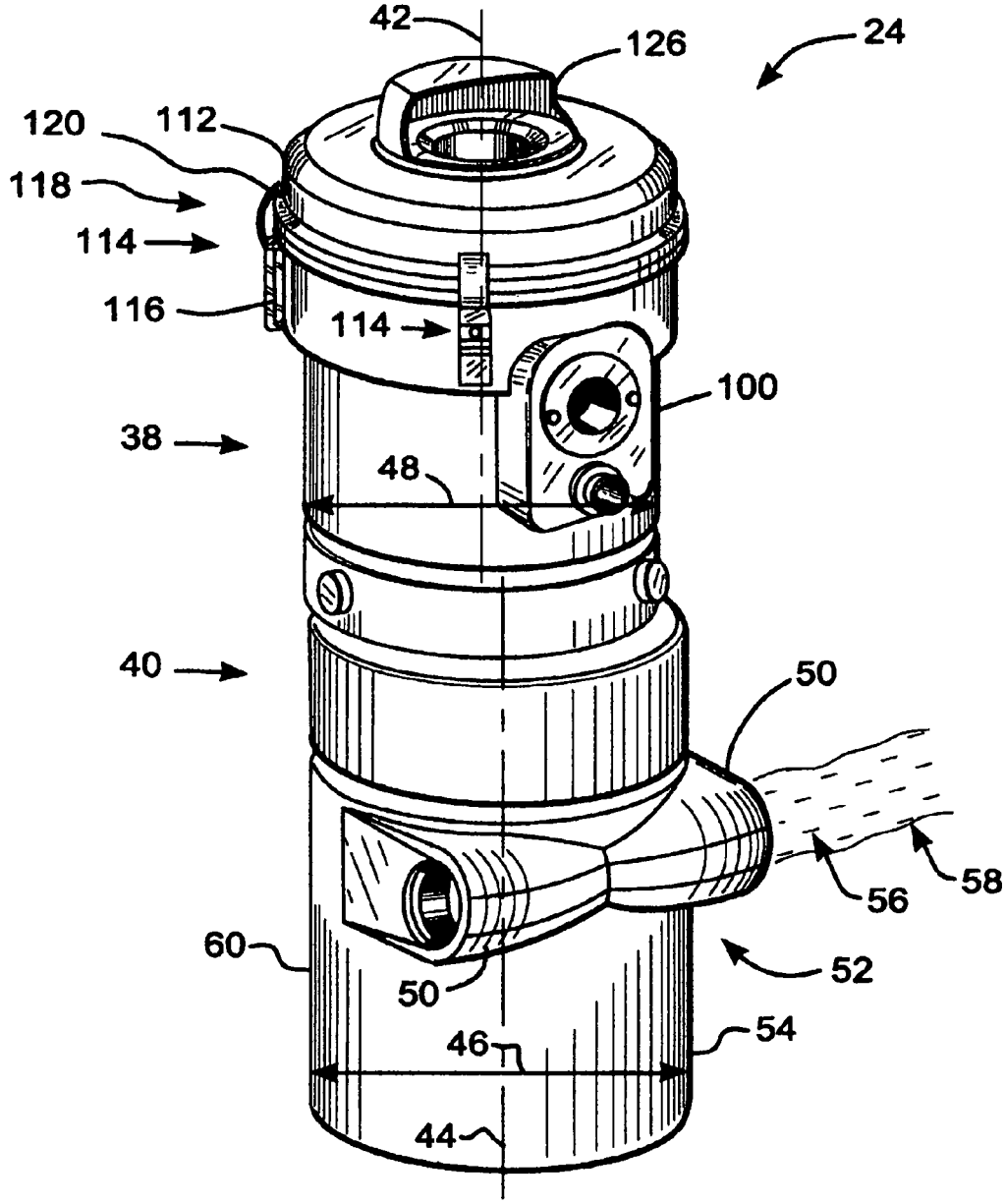
FIG. 2 is a perspective view of an embodiment of a component of the invention depicted in FIG. 1.
Figure 4:
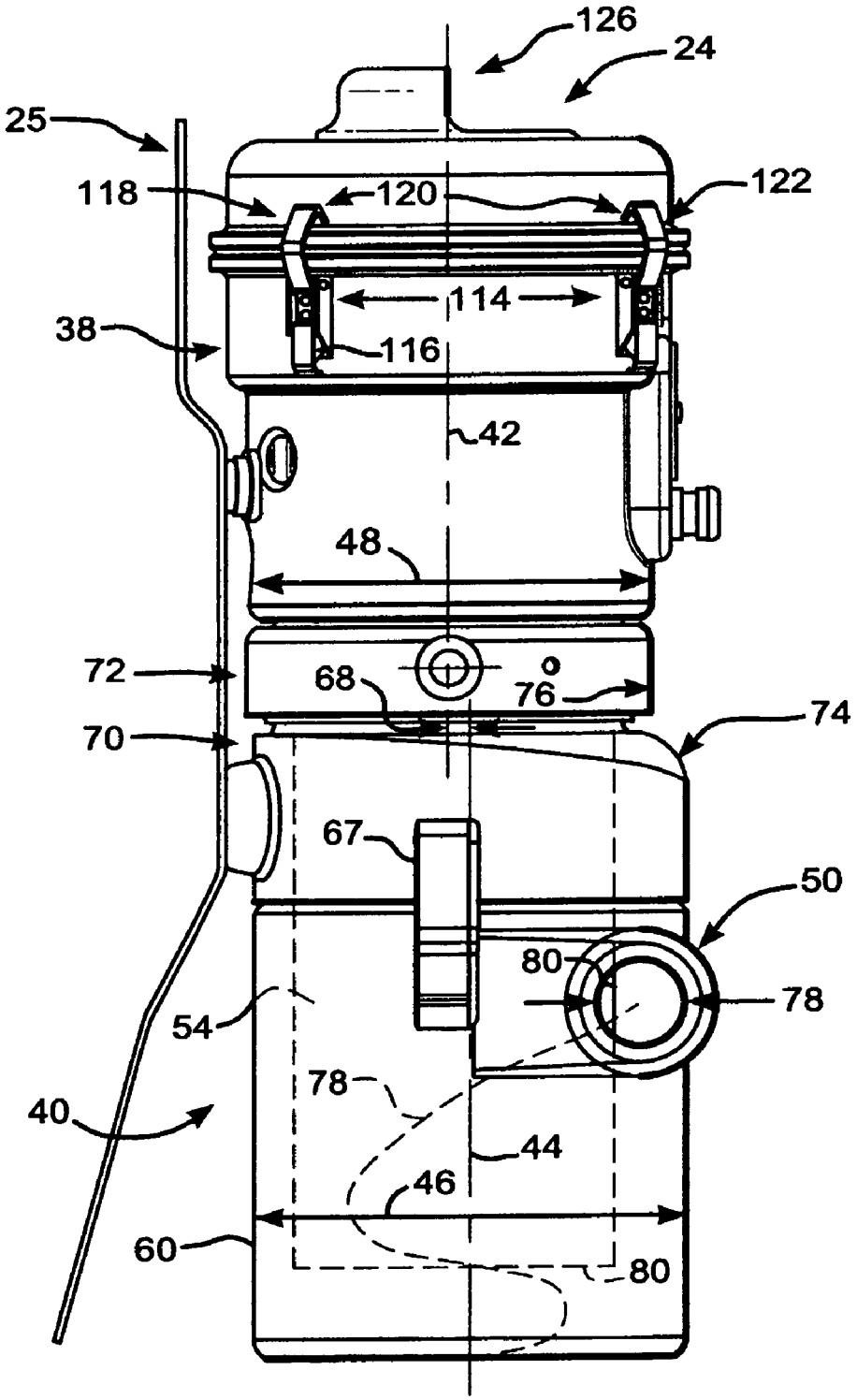
FIG. 4 is a schematic side view of the component depicted in FIGS. 2 and 3.

Referring now to FIG. 2, the vacuum system 24 is depicted as removed from the harness system 22. The vacuum system 24 is selectively removable from the harness system 22 for maintenance, repair and/or cleaning of either the harness system 22 or the vacuum system 24. The harness system 22 may have one or more mechanical fasteners, friction fittings and/or fabric sleeves for receiving or connecting with one or more structures connected to the vacuum system 24 for securing the harness system 22 and the vacuum system 24 together. As seen in FIG. 4, a plate 25 attached to the vacuum system 24 may be secured within the above-mentioned sleeves or secured to the harness system 22 with mechanical fasteners.

In the preferred embodiment depicted in FIGS. 2 and 4, the vacuum system 24 comprises a motor portion 38 and a filter portion 40 disposed below the motor portion 38. The motor portion 38 has a cylindrical design approximately symmetric about a first vertical axis 42. As can be appreciated from FIG. 4, the axis 42 comprises a midline of the motor portion 38. The filter portion 40 has a cylindrical design approximately symmetric about a second vertical axis 44. As can also be appreciated from FIG. 4, the axis 44 comprises a midline of the filter portion 40. The filter portion has a diameter 46 that is larger than the diameter 48 of the motor portion 38.

At least two debris inlets 50 are integrally formed with the filter portion 40. Preferably, the at least two debris inlets 50 are located on an upper, rear portion 52 of the filter portion 40, although those skilled in the art will appreciate that they can be located anywhere on the filter portion 40. In FIG. 2, the debris inlets 50 are depicted as vertically aligned with each other, but other orientations, including vertically offsetting the debris inlets 50, are within the scope of the present invention.

In the preferred embodiment, the debris inlets 50 are in fluid communication with a substantially cylindrical interior portion 54 of the filter portion 40. As seen in FIG. 2, the debris inlets 50 are preferably located on the filter portion 40 to at least initially tangentially communicate debris 56 in a fluid stream 58 into the interior portion 54 of the filter portion 40.

Figure 3:
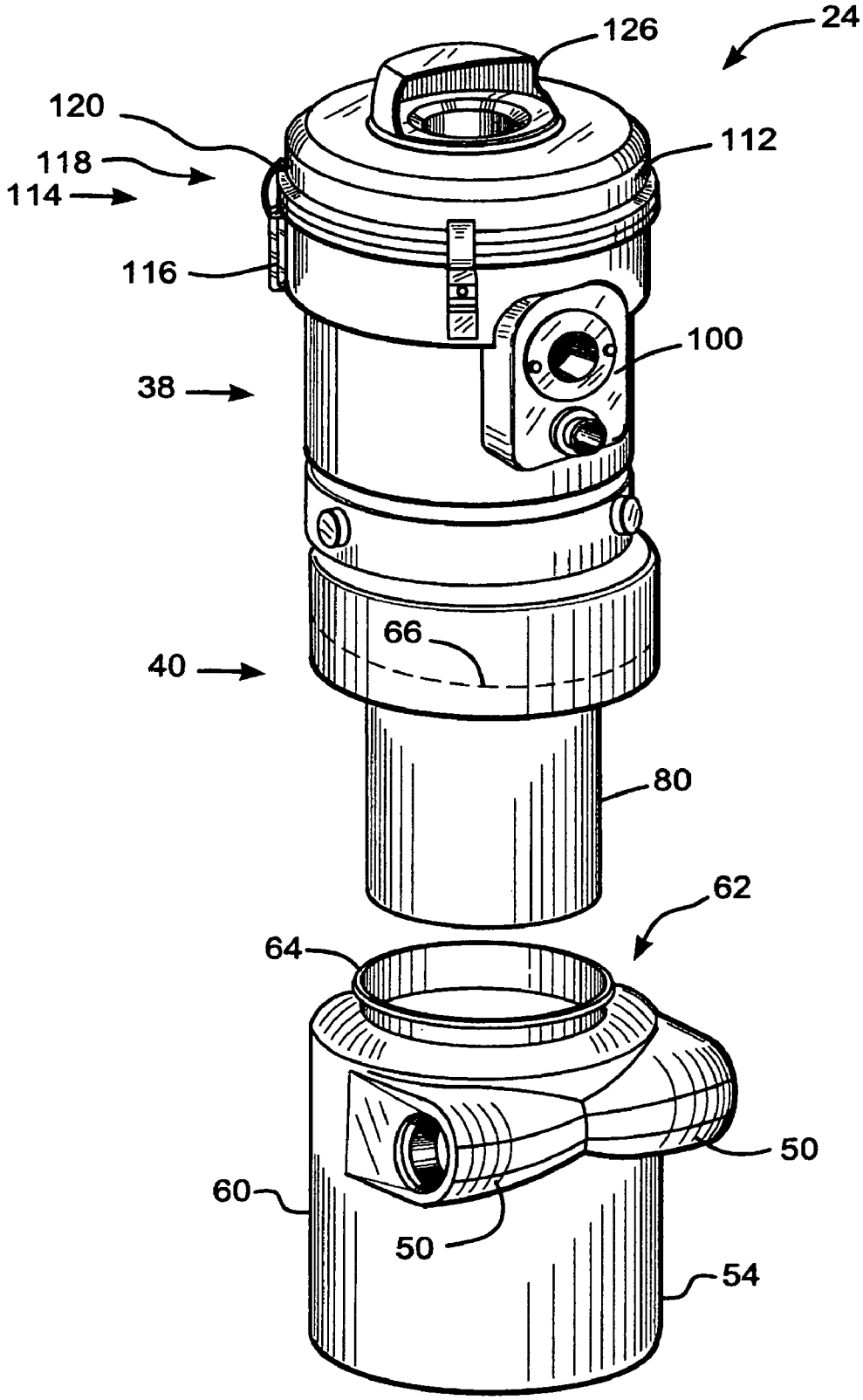
FIG. 3 is a partially exploded perspective view of the component depicted in FIG. 2.

As best seen in FIG. 3, the debris inlets 50 are integrally formed with a canister 60 of the filter portion 40. In the preferred embodiment, the canister 60 has the same diameter as the diameter 46 of the filter portion 40. The canister 60 is removably secured to the filter portion 40. A top surface 62 of the canister 60 has an upstanding portion 64 for connecting with a complementary shaped recess 66 within the filter portion 40. One or more mechanical fasteners, such as the clasps 67, depicted in FIGS. 1 and 4, releasably secure the canister 60 to the filter portion 40. Those skilled in the art will appreciate that other means to releasably secure the canister 60 and the filter portion 40, such as buckles, male/female couplings, screws, bolts, and frictional-type fittings may be used without departing from the scope of the present invention.

The filter portion 40 and the motor portion 38 are designed to engage with one another so that the first vertical axis 42 is offset from the second vertical axis 44 by a predetermined distance 68, as schematically depicted in FIG. 4. Preferably, a portion of the front perimeter 70 of the filter portion 40 and a portion of the front perimeter 72 of the motor portion 38 are horizontally aligned with one another. In this arrangement, the larger diameter 46 of the filter portion 40 results in a portion of the rear perimeter 74 of the filter portion 40 extending rearwardly beyond a portion of the rear perimeter 76 of the motor portion 38. The larger diameter 46 of the filter portion 40 provides a large debris path 78 between the interior portion 54 of the filter portion 40 and a filter 80 or filter shield 82 described in more detail below. The large debris path 78 reduces, or prevents, debris from becoming clogged between the interior portion 54 and the filter 80 or filter shield 82.

Figure 5:
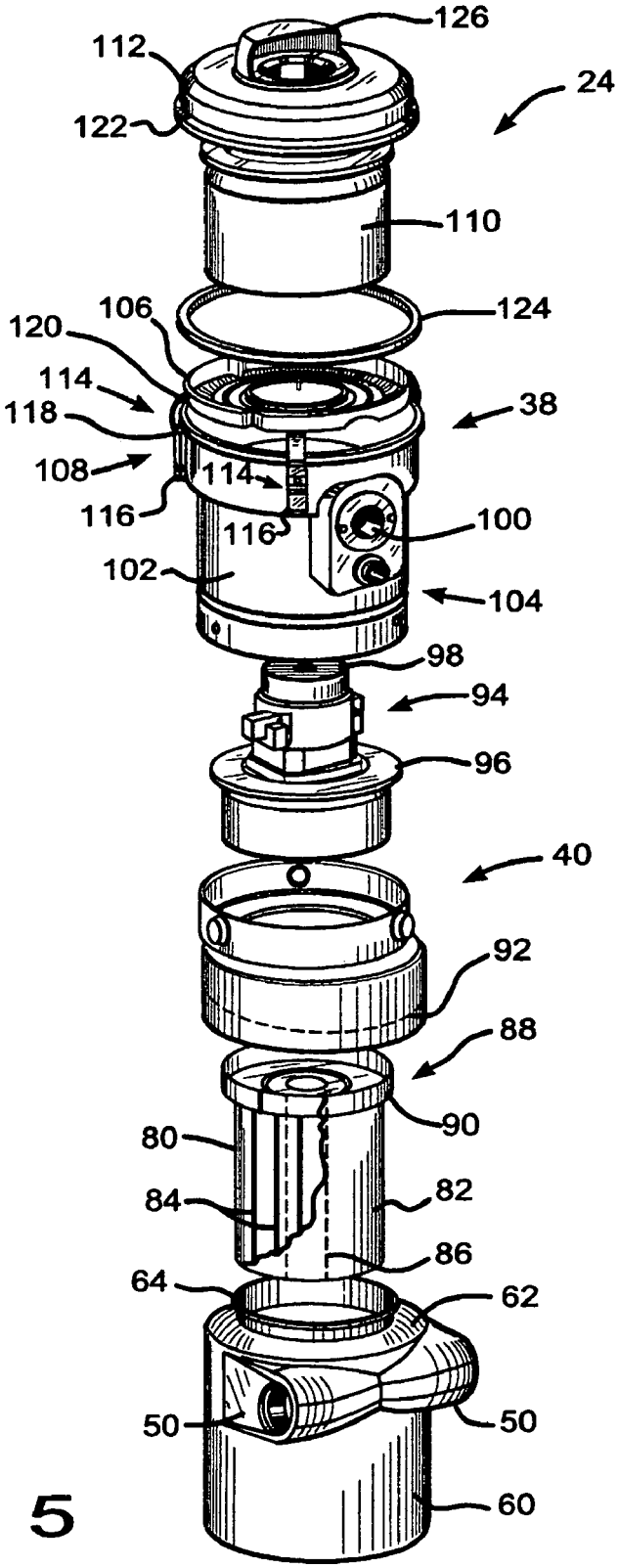
FIG. 5 is a schematic exploded perspective view of the component depicted in FIG. 2.

FIGS. 3 and 5 depict a preferred embodiment of the filter 80 used with the present invention. The filter 80 is a cylindrically shaped filter having a plurality of pleats 84 to increase the surface area for filtering debris from the fluid stream 58. In one embodiment, the filter 80 may be constructed of paper as known to those skilled in the art, however, other filter materials having other shapes may be used without departing from the scope of the present invention. A centrally located fluid channel 86 preferably extends through the entire length of the filter 80.

The shield 82 is preferably located at least partially around the filter 80. The shield 82 reduces, or prevents, debris from becoming lodged within the pleats 84 of the filter 80 from the tangentially positioned debris inlets 50 during operation of the vacuum system 24. The shield 82 may be located around the entire perimeter of the filter 80, as depicted in FIG. 5, or just adjacent the portion of the filter 80 proximate the debris inlets 50.

The filter 80 preferably has an upper surface 88 with an upstanding portion 90. The upstanding portion 90 may be continuous about the upper surface 88 or it may be divided into sections. The upstanding portion 90 is designed to freely fit within a complementary shaped recess 92 in the filter portion 40. Preferably, the upstanding portion 90 is freely engaged with the complementary shaped recess 92 so that the filter 80 can be easily and readily removed for cleaning, maintenance, repair or replacement. The above-described engagement of the filter 80 and the filter portion 40 also facilitates alignment of the canister 60 and filter 80 with the filter portion 40. Those skilled in the art will appreciate that that mechanical devices can be used in addition to, or separately from, the frictional engagement to selectively secure the filter 80 within the filter portion 40.

One or more gaskets (not shown) may be located between the upper surface 88 of the filter 80 and the filter portion 40 to prevent, or reduce, debris from escaping. In one embodiment, the gasket is secured to the filter portion 40.

An electric vacuum motor 94 is mounted within the motor portion 38, as depicted in FIG. 5. The motor 94 is located on a circular plate 96 that can be removably secured to the motor portion 38, such as by one or more mechanical fasteners. The circular plate 96 can be released from the fasteners so that the motor 94 can be removed for cleaning, maintenance, repair or replacement. Preferably, the motor 94 is oriented so that at least one fan 98 driven by the motor 94 creates a vacuum within the filter portion 40.

The filter 80 fits within the canister 60 and functions to prevent, or reduce, the collected debris from escaping from the canister 60. The filter 80 is selectively removable from the canister 60 so that it can be removed and the debris can be emptied from the canister 60.

At least one electrical receptacle 100 is located on an outside surface 102 of the motor portion 40. The electrical receptacle 100 is electrically connected to the motor 94 for supplying electric current. As shown in FIGS. 2, 3, and 5, the electrical receptacle 100 is located on a rear portion 104 of the motor portion 38, however, those skilled in the art will appreciate the electrical receptacle 100 can be located anywhere on the vacuum system 24 to provide the motor 94 with a connection to electrical power.

In one embodiment of the present invention, at least one perforated plate 106 is located in an upper portion 108 of the motor portion 38. The plate 106 supports at least one open cell foam pack 110 that is used to reduce motor and wind noise from the vacuum system 24. Those skilled in the art will appreciate that other materials may also be used to reduce motor and wind noise and filter the fluid stream. By way of example only, the foam pack 110 may be removed and a HEPA filter may be located in its place.

Continuing to refer to FIG. 5, a cover 112 is preferably secured to the upper portion 108 of the motor portion 38 with one or more mechanical fasteners 114. In the preferred embodiment, the mechanical fasteners 114 are of the clasp type having a first end 116 secured to the motor portion 38 and a second end 118 fitted with a hook-like structure 120. The fasteners 114 secure the cover 112 to the motor portion 38 by engaging a circumferential lip 122 about the cover 112 with the hook-like structure 120. The first end 116 is then urged away from the cover 112 by manual means, thus drawing the cover 112 to the motor portion 38. The first end 116 is then locked into place adjacent the outside surface 102 of the motor portion 38.

In the preferred embodiment, at least one gasket 124 is located between the cover 112 and the motor portion 38. The gasket 124 reduces, or prevents, air from escaping between the motor portion 38 and the cover 112.

The cover 112 preferably has at least one integrally formed exhaust vent 126 to direct exhausted air away from the operator. Additional exhaust vents may be used having other shapes and locations than that depicted without departing from the scope of the present invention.

Figure 6:
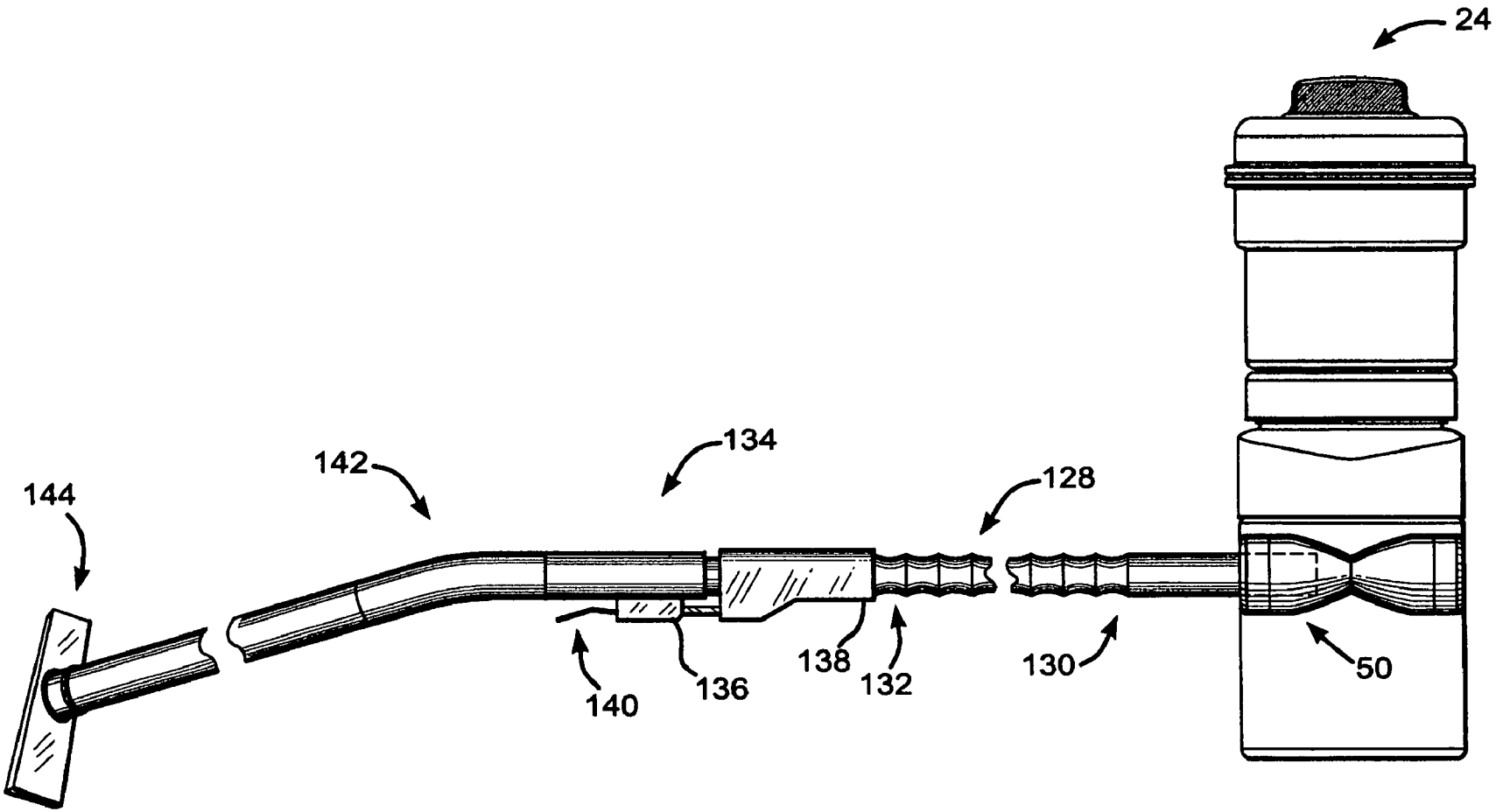
FIG. 6 is a schematic view of some of the components of the present invention.
Figure 7A:
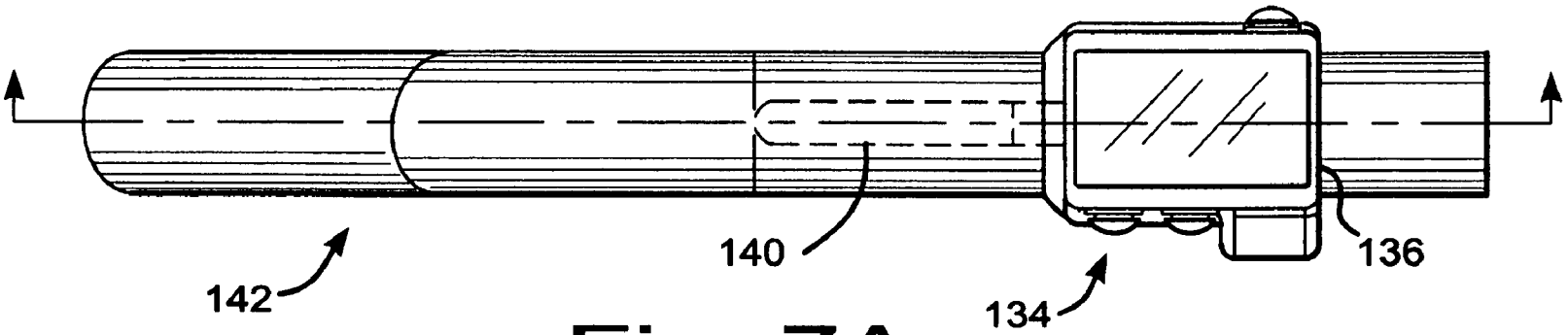
FIG. 7A is a bottom view of another component of the present invention.
Figure 7B:
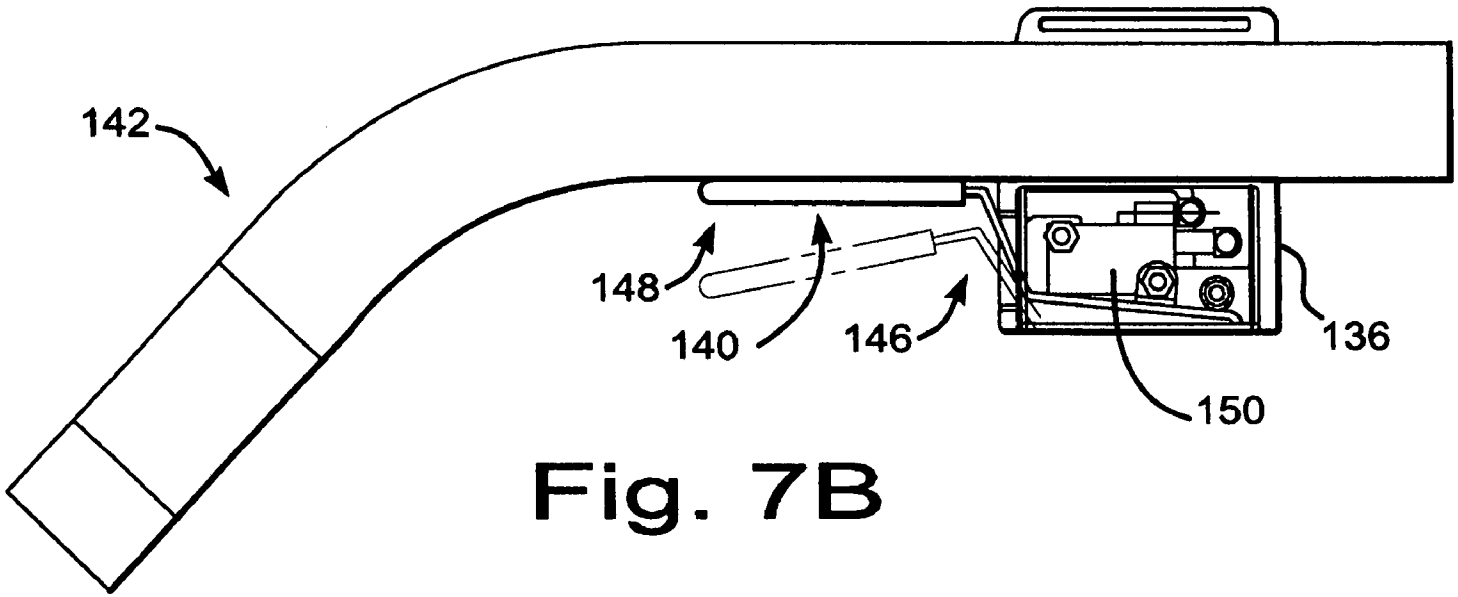
FIG. 7B is a cutaway side view of the component depicted in FIG. 7A along line A-A.

A flexible, air tight vacuum hose 128, as known to those skilled in the art, includes a first end 130 for connecting with either of the two debris inlets 50 and a second end 132 for connecting with a handle 134. A preferred embodiment of the handle 134 is depicted in FIGS. 6, 7A and 7B. The handle 134 comprises a housing 136, a connection portion 138 for the hose 128, a trigger 140 and a wand 142.

The housing 136, as well as the filter portion 40, the motor portion 38 and the cover 112, is preferably rotomolded. As known to those skilled in the art, the rotomolding process typically starts with a cast or fabricated mold. The mold is placed in a rotomolding machine that has at least a loading area, a heating area and cooling area.

Pre-measured plastic resin, such as a high-density polyethylene, is loaded into the mold, then the mold is moved into a heating area where it is slowly rotated about its vertical axis and its horizontal axis. The melting resin sticks to the hot mold and coats every surface evenly. The mold continues to rotate in the cooling area so the formed part retains a uniform wall thickness, if that is desired.

When the part is adequately cooled, it is released from the mold. The rotational speed, heating and cooling times are all controlled throughout the process and may be adjusted based on the design of the product.

In the preferred embodiment, the housing 136 is rotomolded directly to the wand 142. Preferably, the wand 142 is constructed of a metal material, such as an aluminum alloy, although other materials, such as plastic, may be used without departing from the scope of the present invention. It is also preferred that the wand 142 have at least one portion selectively slidable within another portion to provide a telescoping function as known to those skilled in the art. A powered or non-powered floor head 144 is removably attached to the end of the wand 142 for sweeping over and/or agitating a floor surface.

In a preferred embodiment depicted in FIGS. 7A and 7B, the trigger is at least partially mounted within the housing 136 below the wand 142. A first end of the trigger 146 is cantilevered from the housing 136, although a trigger that is not cantilevered is well within the scope of the present invention. A second end 148 of the trigger 140 is connected to a switch 150. A plunger within the switch 150, along with gravity, urges the trigger 140 away from the switch 150. The operator, by using one or more fingers, biases the trigger 140 against the plunger and gravity and moves it toward the handle 134. When the trigger 140 is biased toward the handle 134, an electrical circuit connecting either the batteries 34, or the electrical receptacle 100, and the motor 94 is completed and electricity is provided to the motor 94.

It has been found that by selectively engaging the vacuum system 24 with the trigger 140, battery life is significantly prolonged. It has also been found that by positioning the operator's hand directly on the wand 142 in the area of the handle 134, increased control over the floor head 144 is achieved.

A method of operating the portable vacuum system 20 includes connecting the electrical receptacle 100 to a power source, such as a wall outlet. A standard extension cord can be used to connect the wall outlet with the electrical receptacle 100. Alternatively, the wire 36 connecting the batteries 34 within at least one of the battery compartments 32 to the motor 94 may be used to supply electricity to the motor 94.

In the preferred embodiment, an operator secures the harness system 22, with the vacuum system 24 attached, to his or her back. The operator attaches the first end 130 of the hose 128 to one of the debris inlet 50. Preferably, the operator attaches the first end 130 to the debris inlet 50 that is closest to the hand in which he or she will hold the wand 142. The debris inlet 50 that is not attached to the hose 128 is blocked with a selectively removable cover (not shown).

The operator positions the floor head 144 adjacent or over a spot to be cleaned and engages the trigger 140. Preferably, the operator is grasping the wand 142 so that his or her fingers are below the wand 142 and at least one finger is positioned on the trigger 140. The operator urges the trigger 140 toward the wand 142 thus completing the electrical circuit between the wall outlet or batteries 34 and the electric motor 94.

Energizing the electric motor 94 causes the vacuum fan 98 to spin creating a source of vacuum within the system 24. The source of vacuum draws debris from the floor through the floor head 144 and through the wand 142 and hose 128. The debris enters the debris inlet 50 of the filter portion 40 where at least the tangential orientation of the inlet 50 to the filter portion 40 and the cylindrical shape of the interior portion 54 creates a cyclonic debris path 78 circumferentially in the space between the interior portion 54 of the filter portion 40 and the filter 80, and/or the filter shield 82, as the case may be. In the preferred embodiment, debris in the debris path 78 contacts the filter shield 82 causing the debris to lose velocity. Heavier debris particles, or debris particles with a diminished velocity, fall to the bottom of the filter portion 40 in a downward spiral; other smaller debris particles in the debris path 78 are drawn into the filter 80 where they are removed.

The vacuum fan 98 draws air, cleaned of debris, upwardly through the fluid channel 86 of the filter 80, through the filter portion 40 and through the motor portion 38. The air passes through the foam pack 110 and it is exhausted through the exhaust vent 126. Alternatively, if the HEPA filter is used, the air passes through the HEPA filter and then it is exhausted through the exhaust vent 126.

Additionally circuitry and electrical components, such as one or more microprocessors, may be added to monitor the electrical power remaining in the batteries 34. By way of example only, an electrical component that emits an audible tone can be used to alert the operator of the near depletion of a battery 34. Additionally, an electrical component to automatically cut electrical power to the motor 94 may be added if the component senses that the battery 34 is being depleted beyond a pre-determined point. A pressure differential sensor, as known to those skilled in the art, may also be added to the system 20. The sensor is designed to alert the operator when the canister 60 is full and needs to be emptied. Lights, horns, or other audio and/or visual indicators may be used in association with the sensor.

The system 24 may also have one or more control boards to automatically switch the system 24 from AC to DC power, and vice versa. The control board(s) are designed to sense when AC power is applied and automatically electrically disconnect the batteries 34, if they are still connected.

In accordance with the provisions of the patent statutes, the present invention has been described in what is considered to represent its preferred embodiments. However, it should be noted that the invention can be practiced otherwise than as specifically illustrated and described without departing from its spirit or scope.

What is claimed is:

1. A portable vacuum system, comprising:

a filter portion having a first vertical midline and housing at least one filter; and, a motor portion having a second vertical midline and housing a motor above said filter portion;

wherein said first vertical midline is horizontally offset from said second vertical midline.

2. The system of claim 1, wherein said second vertical midline is positioned forward of said first vertical midline.

3. The system of claim 1, wherein said filter portion has a cylindrical outer surface having at least one debris inlet positioned tangentially on said surface.

4. The system of claim 3, wherein said filter portion has two debris inlets on a rear portion of said filter portion.

5. The system of claim 4, wherein said two debris inlets are vertically aligned with one another.

6. The system of claim 5, wherein said two debris inlets are integrally formed with said filter portion.

7. The system of claim 6, wherein said two debris inlets are in fluid communication with an interior portion of said filter portion.

8. The system of claim 7, wherein said interior portion has a cylindrical shape.

9. The system of claim 8, wherein a canister is releasably secured to said filter portion.

10. The system of claim 9, wherein a first filter is releasably mounted to said filter portion.

11. The system of claim 10, wherein said filter portion suspends said first filter a predetermined horizontal distance from said debris inlets.

12. The system of claim 11, wherein said first filter and said interior portion of said filter portion define a circumferential gap, said gap facilitates cyclonic flow of vacuumed debris.

13. The system of claim 12, wherein a filter shield extends at least partially around said first filter.

14. The system of claim 1, wherein a perforated filter plate is removably secured above said motor.

15. The system of claim 14, wherein a second filter is located adjacent said perforated filter plate.

16. The system of claim 15, wherein an exhaust cover above said motor portion has at least one exhaust port for directing exhausted air rearwardly.

17. The system of claim 1, wherein said motor portion and said filter portion are secured to a harness system.

18. A portable vacuum system, comprising:

a backpack mounted vacuum system having a filter portion having a first vertical midline and a motor portion having a second vertical midline, wherein said first vertical midline is horizontally offset from said second vertical midline; and at least two vertically aligned debris inlets mounted on said filter portion for communicating debris tangentially into an interior portion of said filter portion.

19. The system of claim 18, wherein said at least two debris inlets are selectively closeable.

20. The system of claim 18, wherein said at least two debris inlets are adapted to fluidly connect with a debris wand.

21. The system of claim 18, wherein said at least two debris inlets are integrally formed with said filter portion.

22. The system of claim 18, wherein said at least two debris inlets are located on a canister, said canister being selectively removable from said filter portion.

23. The system of claim 18, wherein said interior portion has a cylindrical shape.

24. The system of claim 23, wherein said filter and said interior portion of said filter portion define a circumferential gap, said gap facilitates cyclonic flow of vacuumed debris.

25. A portable vacuum system, comprising:

a backpack mounted vacuum system having a filter portion having a first vertical midline and a motor portion having a second vertical midline, wherein said first vertical midline is horizontally offset from said second vertical midline; and a debris wand in fluid communication with said filter portion, said debris wand having a trigger selectively biased to interrupt an electrical current to said motor portion, said trigger disposed substantially beneath said debris wand.

26. The system of claim 25, wherein said debris wand is in fluid communication with a flexible hose connected to said filter portion.

27. The system of claim 26, wherein said debris wand has an integrally formed handle portion.

28. The system of claim 27, wherein said trigger is cantilevered from said handle portion by at least one pivotal mounting.

29. The system of claim 28, wherein said trigger connects an electrical circuit between a power source and said motor portion.

* * * * *